US005126558A

United States Patent [19]

Rogers, Jr. et al.

[11] Patent Number: 5,126,558

[45] Date of Patent: Jun. 30, 1992

[54] JOINT POSITION DETECTOR WITH FIBER OPTICAL MICROBEND LOOP

[75] Inventors: Harvey N. Rogers, Jr., Los Angeles; Nicholas Cook, II, Chino, both of Calif.

[73] Assignee: Hughes Aircraft Company, Los Angeles, Calif.

[21] Appl. No.: 612,367

[22] Filed: Nov. 14, 1990

[51] Int. Cl.[5] ..... H01J 40/14

[52] U.S. Cl. ..... 250/227.16; 250/227.21; 73/800

[58] Field of Search ..... 250/227.16, 227.21, 250/227.24, 227.14, 221, 231.1, 231.19; 356/152; 73/800, 705

[56] References Cited

U.S. PATENT DOCUMENTS

| | | | |
|---|---|---|---|
| 4,358,678 | 11/1982 | Lawrence | 250/231.19 |
| 4,407,561 | 10/1983 | Wysocki | 350/96.3 |
| 4,418,984 | 12/1983 | Wysocki et al. | 350/96.33 |
| 4,459,477 | 7/1984 | Agawa et al. | 250/227.16 |
| 4,472,628 | 9/1984 | Whitten | 250/227.14 |
| 4,818,174 | 4/1989 | Arpiarian et al. | 356/152 |
| 4,979,793 | 12/1990 | Bowen et al. | 250/227.16 |

OTHER PUBLICATIONS

Johnson et al, "Macrobend fiber optic transducer for aerospace applications", SPIE vol. 989 Fiber Optic Systems for Mobile Platforms II, 1988, pp. 68-77.

Ohtsuka et al, "Fibre-coil deformation-sensor immune from temperature disturbances", International Journal of Optoelectronics, 1988, vol. 3, No. 5, pp. 371-380.

*Primary Examiner*—David C. Nelms
*Assistant Examiner*—Que T. Le
*Attorney, Agent, or Firm*—M. E. Lachman; W. J. Streeter; W. K. Denson-Low

[57] ABSTRACT

An apparatus for precisely controlling the movement and position of objects. The apparatus includes at least one moveable arm and a system for optically measuring the movement of the arm. The optical measurement system includes an optical fiber loop capable of producing microbend-induced optical attenuation when the loop is physically deformed by the movement of the arm. The apparatus further includes a signal source, a signal detector, and signal processing system for determining the attenuation of the signal between the signal source and the signal detector.

21 Claims, 1 Drawing Sheet

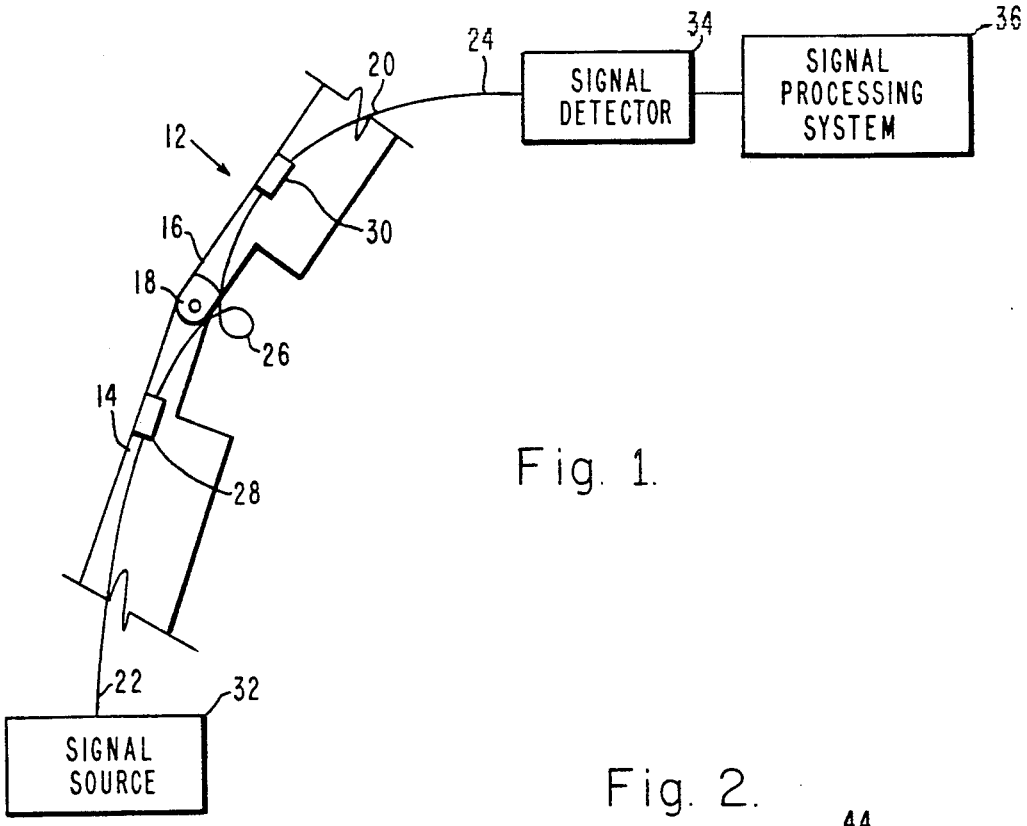
Fig. 1.
Fig. 2.
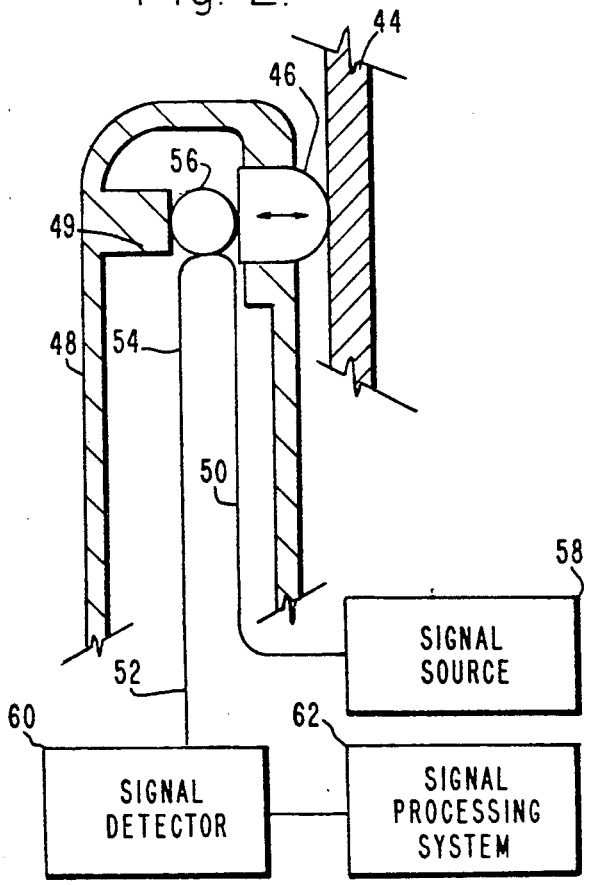

JOINT POSITION DETECTOR WITH FIBER OPTICAL MICROBEND LOOP

BACKGROUND OF THE INVENTION

1. Field of the Invention

The present invention relates in general to apparatus which are designed to move with precision over short distances or exert pressure against objects with a precise tactile force. More particularly, the present invention is directed to apparatus and the sensors which measure the movements and tactile grasp of robotic arms which form an integral part of such apparatus.

2. Description of Related Art

Apparatus such as robot assemblies are utilized in a number of different applications in which an arm is moved short distances or a hand grasps objects during the performance of a function. The effective performance of many of these apparatus depends upon the accurate determination of the distance moved by the arm or the tactile force exerted by the hand. Frequently movements on the order of one millimeter must be controlled so that demanding jobs can be completed with precision. Sensors which detect and determine movement distances and tactile pressures must be capable of continuously detecting the distances and sending the data to a feedback control system so that adjustments in the position of the robotics arm and movement can be made.

In robotics, many measurement and sensor systems have been developed to increase the performance and reliability of robots. Important properties to be measured include displacement, distance, motion, edge, force and tactile sense. One type of distance and displacement sensor known in the art is a magnetic position detector which is based on the Hall effect.

Magnetic position detectors measure small mechanical deflections by sensing variations in electromagnetic fields. One problem associated with the use of magnetic position detectors is their sensitivity to electromagnetic interferences. The information obtained from these magnetic position detectors becomes unreliable when they are subjected to electromagnetic fields which are not related to the robotic movement. Another problem with the magnetic position detectors is the requirement for electrical wiring and the associated electrical power. The use of these detectors in conjunction with measuring the position of robot arms presents potential explosion hazards when the robot is operated in an environment which contains flammable or explosive liquid or gas. In many instances, it is desirable to make these position measurements at high temperatures The robotics assemblies used in such high temperature situations must be both mechanically and thermally rugged. Unfortunately, robotics assemblies which use magnetic position detectors are not well suited for such high temperature applications.

Another type of sensor utilized in robotics is a fiber optic reflectance sensor. These sensors require two optical fibers referred to as a transmitting fiber and a receiving fiber as well as a means for reflecting the signal at the point of movement. In addition to requiring two optical fibers, reflectance response curves generated by these sensors are not linear. Furthermore, these sensors may be adversely affected by contamination of the optical surfaces which are exposed to ambient conditions.

In view of the above considerations, there presently is a need for robotics assemblies that are equipped with sensors which detect movements and tactile feel and are immune to electromagnetic interferences. There is also a need for robotics assemblies having sensors which avoid or minimize explosion hazards and are both mechanically and thermally rugged. The sensor should also be simple in construction without requiring additional components such as the means for reflecting signal mentioned above.

SUMMARY OF THE INVENTION

In accordance with the present invention, an apparatus is provided wherein the movement of at least one member of an arm, hand or other element is optically measured. The optical sensors utilized in the apparatus of the present invention have no potential explosion hazard and they can be used at high temperatures. In addition, the optical sensors utilized in the apparatus of the present invention are not sensitive to variations in electromagnetic fields and they are simply constructed in that they operate effectively using a single optical fiber without a reflectance apparatus.

The optical sensors present in the apparatus of the present invention utilize the microbend-induced attenuation property of optical fibers. This property is characterized by the optical fiber's ability to attenuate light in response to a change in the bend radius of the optical fiber. In a preferred embodiment, the optical fiber comprises a loop.

The apparatus of the present invention includes an arm having two members connected together at a joint. The two members are moveable about the joint to a number of positions relative to each other. The apparatus additionally includes a means for coupling an optical fiber to each of the members so that microbending is induced in the optical fiber in response to the movement. An optical measurement system utilized in the apparatus of the present invention includes a means for measuring the movement or position by detecting light intensity after it is attenuated by the induced microbending.

As a feature of the present invention, the apparatus can be in the form of an arm configured to measure position or an arm configured to indirectly measure pressure. In the case of the configuration which measures position, the optical measurement system determines the movement of the arm directly as the optical fiber microbends in response to the arm movement. Similarly, when the apparatus is configured to measure pressure, the optical measurement system also determines movement. The moving element is a pressure pad which is located in the vicinity of the arm and moves in response to pressure exerted against the arm or exerted by the arm. In the case of a robotics hand the optical measuring system indirectly measures the tactile force of the hand grip by determining the movement of a spring loaded pad which is part of the robotics hand joint. Additionally, the optical measuring system utilized in the present invention can be used as a component of a feedback control system in which position and pressure adjustments are made in response to the measurements.

The apparatus of the present invention may be configured so that no electrical wires or magnetic devices are located in the vicinity of the moving parts. As previously mentioned, this reduces problems with respect to use of the apparatus in explosive environments. Furthermore, the optical fiber sensors used in the apparatus of the present invention are simple in design and possess a mechanical and thermal ruggedness appropriate for use in a variety of environments. Moreover, since the optical path in the optical fiber sensors used in the present apparatus is closed, i.e., uninterrupted, the sensor is not adversely affected by the environmental contaminants.

The above-discussed and many other features and attendant advantages of the present invention will become better understood by reference to the following detailed description when taken in conjunction with the accompanying drawings.

BRIEF DESCRIPTION OF THE DRAWINGS

FIG. 1 is a diagrammatic illustration of an exemplary apparatus in the form of a robot arm having an optical fiber position means.

FIG. 2 is a diagrammatic illustration of an exemplary apparatus in the form of a robot arm having an optical fiber pressure means.

DESCRIPTION OF THE PREFERRED EMBODIMENTS

An exemplary apparatus in accordance with the present invention is shown diagrammatically in FIG. 1 in the form of a robot arm 12. The apparatus includes an arm 12 having a first member 14 and a second member 16 connected together at joint 18. The first member 14 and second member 16 are moveable relative to each other about the joint 18 to a plurality of positions. In accordance with the present invention, the apparatus includes a system for optically measuring the movement and position of the first member 14 and the second member 16 relative to each other. As further illustrated in FIG. 1 the optical measurement system has three basic components. The first component is at least one optical fiber 20 which is capable of providing optical attenuation in response to microbending of the optical fiber. The optical fiber utilized in the apparatus of the present invention further includes an input portion 22, an output portion 24, and a loop portion 26 located between the input portion 22 and the output portion 24. The loop portion 26 can be in the form of a partial loop, a single full loop, or more than one full loop. It is preferred that a plurality of loops be present in the loop portion in order to enhance measurement accuracy.

The optical fiber utilized in the optical measurement system of the present invention further includes a means, such as clamp 28, for fixedly coupling the optical fiber input portion 22 to the first member 14. Means, such as clamp 30, are also provided for fixedly coupling the optical fiber output portion 24 to the second member 16 wherein movement of the first member 14 and second member 16 causes microbending of the optical fiber loop portion 24. In addition to fixedly clamping the optical fibers to each member, a number of other methods for coupling the optical fiber to the arm member are suitable for use in the present invention. These methods are discussed in more detail below.

The second component of the optical measurement system is a signal source 32 which is coupled to the optical fiber input portion 22. The third component includes a signal detector 34 which is coupled to the optical fiber output portion 24, and to a signal processing system 36 for determining the modulation of the optical signal between the input portion 22 and the output portion 24 of the optical fiber 20.

As discussed more thoroughly below, the signal source 32 introduces an optical signal into the optical fiber input portion 22 and the signal detector 34 detects the optical signal at the output portion 24 of the optical fiber. The signal processing system 36 provides a measure of the movement and position of the first member 14 and the second member 16 of the arm.

During operation of the apparatus of the present invention, radiation is emitted from the signal source 32 and then propagated through the optical fiber 20 to the detector 34 and the signal processing system 36. When the first member 14 or second member 16 moves or is displaced, the resulting movement deforms the optical fiber loop portion 26. The radiation propagating through the optical fiber 20 is attenuated by the deformation in the loop portion 26. The amount of deformation is related to the amount of movement. And in turn the degree of attenuation is related to the amount of deformation. The attenuation in the loop portion 26 is measured by way of the optical detector 34 and signal processing unit 36, each of which is more thoroughly described below.

FIG. 2 illustrates a second embodiment of the present invention in which pressure exerted by or against a member is measured. As shown in FIG. 2, the apparatus includes a moveable member 44 which is capable of exerting pressure on an object or having pressure exerted against it. The member 44 can be one of the members of a robotic arm as shown in FIG. 1. The member 44 could also be a finger on a robotic hand or part of any other robotic element where the measurement of pressure exerted by or against the element requires monitoring. The apparatus further includes an optical pressure measurement system which provides means for optically measuring the pressure exerted by the member or against the member.

The optical measurement system of the embodiment illustrated in FIG. 2 incorporates the same three components described above and illustrated in FIG. 1 including an optical fiber 54, with input end 50, output end 52, and loop portion 56, a signal source 58, a signal detector 60, and a signal processing system 62. Each of these elements has all the characteristics and functions described above for FIG. 1. In order to indirectly measure pressure applied by or to member 44, the optical measurement system illustrated in FIG. 2 additionally includes a pressure pad 46 which is laterally moveable within housing 48. The pressure pad 46 and its housing 48 are located in close proximity to member 44 to facilitate a response by the pressure pad 46 to pressure exerted by or against member 44. The pressure pad may also be housed with the member itself rather than in a separate housing as shown in FIG. 2. The pressure pad 46 is further attached to the adjacent section of the optical fiber loop portion 56, such as by epoxy or solder. The pressure pad 46 is spring loaded or otherwise biased so that lateral movement of the pressure pad 46 provides an indirect measurement of the pressure being exerted by or against member 44. Different degrees of spring loading or biasing are used depending upon the intended use for the member 44. The section of the optical fiber loop portion 56 which is opposite the housing 48 is attached such as by epoxy or solder, to the housing 48, such as by a support structure or standoff 49, which may be integral with the housing 48.

In accordance with the present invention, the operation of the apparatus illustrated in FIG. 2 is similar to the operation of the embodiment described above for FIG. 1. Radiation is emitted from the signal source 58 and then propagated through the optical fiber 54 to the detector 60 and the signal processing system 62. When member 44 moves in response to exerting pressure or having pressure exerted against it, pressure pad 46 simultaneously moves laterally within housing 48. The lateral movement induces microbending deformation in the optical fiber loop portion coupled to the pressure pad 46. Radiation propagating through the optical fiber 54 is attenuated by the deformation in the loop portion 56. The degree of attenuation is related to the amount of deformation and indirectly to the amount of pressure exerted by or against member 44. Thus, the deformation of the loop portion 56 and the resulting attenuation of the signal intensity at detector 60 is a measure of pressure at member 44.

In accordance with an alternative embodiment of the present invention, the optical fiber sensor systems of FIGS. 1 and 2 may be combined in a single apparatus. For example, a robotic arm may have the apparatus of FIG. 1 at the elbow and the apparatus of FIG. 2 at the gripper hand.

The optical fiber pressure and position sensor systems can be part of a feedback control system in which the robotics assembly can instantaneously compensate for too little or too much pressure or movement applied by the arm member to an object. By continuously monitoring the signals exiting from the optical fibers shown in both FIGS. 1 and 2, a constant measure of the robot arm movement and/or the robot hand pressure can be made. This constant measuring provides a feedback control system in which movements and pressures are determined and then adjustments are made if necessary. In the embodiment shown in FIG. 1 in which the apparatus is a robotic arm, the movement is generally an angular displacement over a distance defined by the length of the arm 12 and the angle of the joint 18. The deformation of the loop portion 20 is a measure of the angular displacement. Accordingly, continuous monitoring of the loop deformation provides an immediate measure of arm position so that instantaneous compensations can be made when angular displacements become too great or too small. If the movement is too great or too small the angular displacement will be too great or too small for the particular application. By measuring the attenuation, the apparatus can instantaneously compensate.

The apparatus of the present invention are specially useful for a number of applications in the field of robot feedback control systems. Apparatus in which movements on the order of from about 0.1 millimeters to about 3 millimeters are regularly monitored are particularly suitable in the practice of the present invention For example, specialized manufacturing robots are used in high precision operations in the electronics industry.

One of the possible applications of flexible assembly robots is the insertion of special components on printed circuit boards. Frequently these robots are required to make small movements with a resolution of less than 1 millimeter. Such robot arms can be formed from a variety of different materials including metals, plastics, and glasses. The only limitation on the material is that the physical and environmental requirements of the robot function must be met by the physical and chemical characteristics of the material. As mentioned above, robots are routinely used in harsh environments in which extreme temperatures and toxic or corrosive chemicals are present. Consequently, a moveable arm 12 utilized in such environment must be constructed to withstand the harsh surroundings. Additionally, as discussed below, the moveable arm 12 must have surfaces that can be mechanically or adhesively bonded to the optical fiber.

The signal source can be any radiation source with the appropriate intensity and wavelength emission The signal source must also be configured so that it can be coupled to the input end of the optical fiber. Light-emitting diode (LED) sources combine the characteristics of a small surface area and high intensity which makes them particularly suitable as a source in the present invention. The intensity of the radiation emitting from LEDs is easily controlled by varying the current to optimize the sensor performance. An alternative to the use of LED sources is the injection laser source. These sources are small, rugged and efficient. Accordingly, they also are well suited for providing optical input into the optical fiber.

The detector is preferably a radiation detector having a high sensitivity for the wavelength emitted by the signal source. The response time of the radiation detectors must be fast enough to accommodate rapid changes in the attenuation caused by movement of the optical fiber loop portion which, in turn, is caused by movement at the joint. Silicon photodiodes are preferred radiation detectors for most applications. These photodiodes are commercially available and capable of reliably and rapidly measuring radiation intensities propagated by optical fibers.

The signal processing systems 36 and 62 include a signal conditioning amplifier which receives the signals from the detector for conditioning and transmittal to the signal processing unit. The signal conditioning amplifier and processing unit convert the signal inputs into movement readings based upon the known interrelationships between known movement values or forces and the attenuation of the radiation due to the microbend deformation of the optical fiber. Details regarding the relationship between fiber-coil deformation and radiation attenuation are described in the following two articles, the contents of which are hereby incorporated by reference: Johnson, et al., "Macrobend Fiber-optic Transducer for Aerospace Applications," SPIE Volume 989 Fiberoptic Systems for Mobile Platforms II (1988), pp.68–77, and Y. Ohtsuka, et al., "Fibre-Coil Deformation-Sensor Immune from Temperature Disturbances," *International Journal of Opto-Electronics,* 1988, Volume 3, No. 5, pp. 371–380.

The apparatus of the present invention provides a number of advantages over other movement or pressure sensor apparatus which have been used in the past. For example, the signal source, detector, signal conditioning amplifier and signal processing unit can all be remotely located from the moveable arm. The ability to isolate the signal processing elements of the system at a remote location makes it possible to use the robotics assembly in a wide variety of environments. The only connection between the arm and the signal processing elements is the optical fibers. Since there are no electrical wires, the explosion hazards are greatly minimized.

Metal or alloy clad optical fibers comprising a glass or $SiO_2$-based fiber having a coating of metal surrounding the fiber, such as those disclosed in U.S. Pat. Nos. 4,418,984 and 4,407,561, assigned to the same assignee as the present application, can be used. This type of metal clad optical fiber is capable of withstanding temperatures on the order of 427° C. (800° F.) without being adversely affected by reactive or toxic gases and liquids or high humidities. Both aluminum-coated optical fibers and gold-coated optical fibers have been found to be useful when operating in this temperature range. In addition, optical fibers coated with an inorganic coating, such as a ceramic, or optical fibers coated with an organic coating, such as a plastic, may be used in the present invention provided that the coating can withstand elevated temperatures and can provide a good bond to the pressure pad or arm members. In coupling the optical fibers to the pressure pad or arm members, it is important that the coupling be a solid connection so that the arm movements result in accurate and repeatable deformations of the optical fiber loops.

Mechanical coupling of the optical fiber loops directly to the apparatus of the embodiment shown in FIG. 1 or to the pressure pad, as shown in FIG. 2, is particularly attractive for its simplicity. The coupling can be accomplished by soldering the apparatus to a metallized covering on the optical fiber. A particularly useful method for coupling, for example, stainless steel to a metal- or alloy-clad optical fiber involves electroplating a layer of gold onto the metal or alloy in the area of the optical fiber loop portion and soldering the stainless steel joint to the electroplated area. The layer of gold is typically less than 10 micrometers thick and provides a surface which enhances the effectiveness of the soldering.

Alternatively, the coupling of the optical fiber loops to the apparatus can be accomplished with the use of an appropriate adhesive This is a particularly useful method when the pressure pad is directly coupled to the optical fiber loop. High temperature adhesives may be used in applications which require the optical fiber and the moveable arm to be subjected to elevated temperatures. Adhesives with extreme hydrolytic stability are preferred when the robotics assembly will be subjected to high humidities.

Another method for coupling the optical fiber loops with the apparatus consists of a magnetic coupling. This method is suitable for application in which a magnetic field variation is produced in response to arm movement. Optical fiber loops with a magnetostrictive coating will compress in response to the magnetic field variation. Similarly, for situations in which a variation in an electrostatic field is produced by the movement at the joint, an optical fiber can be configured to be repelled or attracted by the electrostatic field variation.

In order to verify that the apparatus of FIGS. 1 and 2 are sufficiently responsive to small movements to provide a satisfactory output signal, the following experiment was performed. Four loops of an aluminum-coated silica optical fiber having a 154 micron core, a 180 micron clad, and a 203 micron coating of aluminum were placed in contact with the vibrating cone of an audio loudspeaker which was connected to a 100 hertz (Hz) sinewave generator. A light-emitting diode (LED) directed light into the fiber, and a silicon photodiode measured the light intensity out of the fiber. The percent modulation of transmitted light intensity was measured to determine the sensitivity of the fiber optic loops to mechanical deflections up to 70 mils (0.003 cm) at a vibration frequency of 100 Hz. The tests were repeated using four loops of an aluminum-coated silica optical fiber having a 73 micron core, a 99 micron clad, and a 124 micron coating of aluminum. The vibration amplitude was plotted versus percent optical modulation, using different LED current levels. The results indicated that the percent modulation is approximately linearly proportional to the vibration amplitude for a given LED current. In addition, it was found that the percent modulation increases with decreasing LED current since the higher order modes provided by LEDs at low current levels are more sensitive to microbending. Thus, it can be seen that the fiber optic loops are able to detect small mechanical deflections, as required in the apparatus of FIGS. 1 and 2.

Having thus described preferred exemplary embodiments of the present invention, it should be noted by those skilled in the art that the disclosures herein are exemplary only and that alternatives, adaptations and modifications may be made within the scope of the present invention. Accordingly, the present invention is not limited to the specific embodiments as illustrated herein, but is only limited by the following claims.

What is claimed is:

1. An apparatus comprising:

an arm having a first member and a second member, said first and second members being connected together at a joint and moveable relative to each other about said joint to a plurality of positions; and optical fiber position means coupled to said arm for optically measuring the movement and position of said first and second members relative to each other, wherein said optical fiber position means comprises:

(a) at least one optical fiber capable of providing optical attenuation in response to microbending of said optical fiber, said optical fiber having an input portion, an output portion and a loop portion therebetween, located in proximity to said joint;

(b) means for fixedly coupling said optical fiber input portion to said arm first member;

(c) means for fixedly coupling said optical fiber output portion to said arm second member wherein the movement of said first and second members relative to each other causes microbending of said optical fiber loop portion;

(d) signal source means coupled to the optical fiber input portion for introducing an optical signal into said optical fiber;

(e) detector means coupled to the optical fiber output portion for measuring the optical signal at the output portion of said optical fiber; and (f) means for determining the modulation of said optical signal between said input portion and said output portion of said optical fiber to provide a measure of the movement and position of said first and second members of said arm.

2. An apparatus according to claim 1 wherein said loop portion comprises a single loop.

3. An apparatus according to claim 1 wherein said loop portion comprises a plurality of loops.

4. An apparatus according to claim 1 wherein said optical fiber comprises metal-coated glass.

5. An apparatus according to claim 1 wherein said arm is part of a robotics elbow assembly.

6. An apparatus according to claim 5 wherein said movement is an angular displacement of said arm.

7. An apparatus according to claim 1 wherein at least one of said first and second members includes optical fiber pressure means for optically measuring pressure exerted against said member, wherein said optical fiber pressure means comprises at least one optical fiber capable of providing optical attenuation in response to microbending of said optical fiber.

8. An apparatus according to claim 7 wherein said optical fiber pressure means comprises:

pressure pad means for measuring pressure applied to a pressure pad wherein said pad is located adjacent to one of said members and is moveable laterally in response to pressure; and at least one optical fiber having an input portion, an output portion, and a loop portion coupled on one side to said pressure pad and on the opposite side to a support structure;

signal source means coupled to the optical fiber input portion for introducing an optical signal into said optical fiber;

detector means coupled to the output end of the optical fiber for measuring the optical signal at the output end of said optical fiber; and means for determining the modulation of said optical signal between the input portion and output portion of said optical fiber to provide a measure of the lateral movement of said pressure pad in response to said pressure.

9. An apparatus according to claim 8 wherein said arm is part of a robotics gripper hand.

10. An apparatus according to claim 7 wherein said loop portion is a single loop.

11. An apparatus according to claim 7 wherein said loop portion is a plurality of loops.

12. An apparatus according to claim 7 wherein said optical fiber comprises metal-coated glass.

13. An apparatus according to claim 7 wherein said movement is a tactile grip.

14. An apparatus comprising:

an arm having at least one member, said member being moveable in response to pressure;

optical fiber pressure means adjacent to said member for optically measuring pressure exerted by or against said member, wherein said optical fiber pressure means comprises:

(a) at least one optical fiber capable of providing optical attenuation in response to microbending of said optical fiber, said optical fiber having an input portion, an output portion and a loop portion coupled on one side to said pressure pad and on the opposite side to a support structure;

(b) pressure pad means for measuring pressure applied to a pressure pad wherein said pad is located adjacent to said member and is moveable laterally in response to pressure;

(c) signal source means coupled to the optical fiber input portion for introducing an optical signal into said optical fiber;

(d) detector means coupled to the output end of the optical fiber for measuring the optical signal at the output end of said optical fiber; and (e) means for determining the modulation of said optical signal between the input portion and output portion of said optical fiber to provide a measure of the lateral movement of said pressure pad in response to said pressure.

15. An apparatus according to claim 14 wherein said arm is part of a robotics hand gripper.

16. An apparatus according to claim 14 wherein said loop portion is a single loop.

17. An apparatus according to claim 14 wherein said loop portion is a plurality of loops.

18. An apparatus according to claim 14 wherein said optical fiber is metal-coated glass.

19. A method for determining movement comprising:

providing an arm having a first member and a second member, said first and second members being connected together at a joint and moveable relative to each other about said joint to a plurality of positions;

coupling an optical fiber to said first member and said second member, wherein said optical fiber has an input portion, an output portion, and a loop portion therebetween located in proximity to said joint, and said optical fiber responds to said movement with microbending;

optical measuring a microbend induced optical attenuation by the steps of:

(a) introducing an optical signal into said input end of said optical fiber;

(b) measuring said optical signal at said output end of said optical fiber;

(c) determining said attenuation of said optical signal between said input end and said output end of said optical fiber; and determining said movement based on said measurement of said attenuation.

20. A method for determining movement according to claim 19 wherein at least one of said first and second members includes optical fiber pressure means for optically measuring pressure exerted against said member, wherein said optical fiber pressure means comprises at least one optical fiber capable of providing optical attenuation in response to microbending of said optical fiber.

21. A method for determining movement according to claim 19 wherein said loop portion comprises a plurality of loops.

* * * * *